US007390263B1

(12) United States Patent
Acres

(10) Patent No.: US 7,390,263 B1
(45) Date of Patent: Jun. 24, 2008

(54) METHOD OF IMPLEMENTING CASHLESS PLAY OF GAMING DEVICES INTERCONNECTED BY A COMPUTER NETWORK

(75) Inventor: John F. Acres, Corvallis, OR (US)

(73) Assignee: IGT, Reno, NV (US)

( * ) Notice: Subject to any disclaimer, the term of this patent is extended or adjusted under 35 U.S.C. 154(b) by 963 days.

(21) Appl. No.: 09/694,065

(22) Filed: Oct. 19, 2000

(51) Int. Cl.
*A63F 9/22* (2006.01)

(52) U.S. Cl. ..... 463/27

(58) Field of Classification Search ..... 463/25
See application file for complete search history.

(56) References Cited

U.S. PATENT DOCUMENTS

| | | | | |
|---|---|---|---|---|
| 3,598,964 | A | 8/1971 | Dell et al. | 235/61.6 R |
| 4,072,930 | A | 2/1978 | Lucero et al. | 340/152 T |
| 4,230,265 | A | 10/1980 | Casaly | 235/455 |
| 4,258,838 | A | 3/1981 | Rockola et al. | 194/1 R |
| 4,283,709 | A | 8/1981 | Lucero et al. | 340/147 R |
| 4,335,809 | A | 6/1982 | Wain | 194/1 R |
| 4,467,424 | A | 8/1984 | Hedges et al. | 364/412 |
| 4,575,622 | A | 3/1986 | Pellegrini | 235/382 |
| 4,624,459 | A | 11/1986 | Kaufman | 273/143 R |
| 4,636,951 | A | 1/1987 | Harlick | 364/412 |
| 4,652,998 | A | 3/1987 | Koza et al. | 364/412 |
| 4,669,596 | A | 6/1987 | Capers et al. | 194/210 |
| 4,669,730 | A | 6/1987 | Small | 273/138 A |

(Continued)

FOREIGN PATENT DOCUMENTS

AU B-27572/84 11/1984

(Continued)

OTHER PUBLICATIONS

Canadian Office Action dated Mar. 22, 2005, from Canadian Application No. 2,359,127.

(Continued)

*Primary Examiner*—Corbett B. Coburn
(74) *Attorney, Agent, or Firm*—Weaver Austin; Villeneuve & Sampson LLP

(57) ABSTRACT

A method for transferring credits between gaming devices connected by a network to a host computer comprising. A player account accessible by the host computer is created. The player can access the account by inserting a card into a card reader at one of the gaming devices. A casino employee may apply credit to the account responsive to receipt of funds from the player. A predetermined amount of credit is transferred from the account to an EGM responsive to a command entered by the player at the EGM. Alternatively, the player applies a credit to the gaming device, typically by inserting bills into a bill acceptor. The credit and any awards resulting from gaming-device play are stored on a credit meter associated with the gaming device. Access to the account is terminated when the player withdraws the card from the card reader. A player initiates a request to redeem the balance stored on the credit meter by depressing a cash-out button. The balance on the credit meter is transferred to the player account if the cash-out button is pressed before the card is withdrawn, and is paid to the player via the gaming machine if the button is pressed after the card is withdrawn. All transactions are backed up on a database.

32 Claims, 4 Drawing Sheets

U.S. PATENT DOCUMENTS

| | | | | | |
|---|---|---|---|---|---|
| 4,679,143 | A | | 7/1987 | Hagiwara | 364/412 |
| 4,760,247 | A | | 7/1988 | Keane et al. | 235/454 |
| 4,764,666 | A | | 8/1988 | Bergeron | 235/380 |
| 4,775,937 | A | | 10/1988 | Bell | 364/412 |
| 4,805,907 | A | | 2/1989 | Hagiwara | 273/138 A |
| 4,815,741 | A | | 3/1989 | Small | 273/138 A |
| 4,837,728 | A | | 6/1989 | Barrie et al. | 364/412 |
| 4,839,640 | A | | 6/1989 | Ozer et al. | 340/825.31 |
| 4,856,787 | A | | 8/1989 | Itkis | 273/237 |
| 4,880,237 | A | * | 11/1989 | Kishishita | 273/143 R |
| 4,882,473 | A | | 11/1989 | Bergeron et al. | 235/380 |
| 4,926,996 | A | | 5/1990 | Eglise et al. | 194/212 |
| 4,964,638 | A | | 10/1990 | Ishida | 273/138 A |
| 4,991,848 | A | | 2/1991 | Greenwood et al. | 273/138 R |
| 5,038,022 | A | * | 8/1991 | Lucero | 235/375 |
| 5,042,810 | A | | 8/1991 | Williams | 273/142 |
| 5,096,195 | A | | 3/1992 | Gimmon | 273/138 A |
| 5,103,081 | A | | 4/1992 | Fisher et al. | 235/464 |
| 5,116,055 | A | | 5/1992 | Tracy | 273/138 A |
| 5,123,649 | A | | 6/1992 | Tiberio | 273/143 R |
| 5,135,224 | A | | 8/1992 | Yamamoto et al. | 273/143 R |
| 5,159,549 | A | | 10/1992 | Hallman, Jr. et al. | 364/412 |
| 5,179,517 | A | | 1/1993 | Sarbin et al. | 364/410 |
| 5,197,094 | A | | 3/1993 | Tillery et al. | 379/91 |
| 5,217,224 | A | | 6/1993 | Sincock | 273/138 A |
| 5,249,800 | A | | 10/1993 | Hilgendorf et al. | 273/138 A |
| 5,257,179 | A | | 10/1993 | DeMar | 364/410 |
| 5,265,874 | A | | 11/1993 | Dickinson et al. | 273/138 A |
| 5,275,400 | A | | 1/1994 | Weingardt et al. | 273/85 CP |
| 5,280,909 | A | | 1/1994 | Tracy | 273/138 A |
| 5,286,023 | A | | 2/1994 | Wood | 273/138 A |
| 5,287,269 | A | | 2/1994 | Dorrough et al. | 364/408 |
| 5,290,033 | A | | 3/1994 | Bittner et al. | 273/138 A |
| 5,292,127 | A | | 3/1994 | Kelly et al. | 273/138 R |
| 5,321,241 | A | | 6/1994 | Craine | 235/380 |
| 5,326,104 | A | | 7/1994 | Pease et al. | 273/138 A |
| 5,344,144 | A | | 9/1994 | Canon | 273/138 A |
| 5,345,379 | A | | 9/1994 | Brous et al. | 364/140 |
| 5,370,306 | A | | 12/1994 | Schulze et al. | 273/138 A |
| 5,371,345 | A | | 12/1994 | LeStrange et al. | 235/380 |
| 5,429,361 | A | * | 7/1995 | Raven et al. | 273/138 |
| 5,470,079 | A | * | 11/1995 | LeStrange et al. | 463/25 |
| 5,472,194 | A | | 12/1995 | Breeding et al. | 273/138 A |
| 5,473,144 | A | | 12/1995 | Mathurin, Jr. | 235/380 |
| 5,477,040 | A | | 12/1995 | Lalonde | 235/379 |
| 5,494,287 | A | | 2/1996 | Manz | 273/143 R |
| 5,533,727 | A | | 7/1996 | DeMar | 463/23 |
| 5,536,016 | A | | 7/1996 | Thompson | 273/269 |
| 5,559,312 | A | | 9/1996 | Lucero | 235/380 |
| 5,564,700 | A | | 10/1996 | Celona | 463/27 |
| 5,577,959 | A | | 11/1996 | Takemoto et al. | 463/25 |
| 5,580,309 | A | | 12/1996 | Piechowiak et al. | 463/16 |
| 5,580,310 | A | | 12/1996 | Orus et al. | 763/16 |
| 5,586,936 | A | | 12/1996 | Bennett et al. | 463/25 |
| 5,586,937 | A | | 12/1996 | Menashe | 463/41 |
| 5,611,730 | A | | 3/1997 | Weiss | 463/20 |
| 5,655,961 | A | | 8/1997 | Acres et al. | 463/27 |
| 5,674,128 | A | | 10/1997 | Holch et al. | 463/42 |
| 5,702,304 | A | | 12/1997 | Acres et al. | 463/29 |
| 5,722,891 | A | | 3/1998 | Inoue | 463/20 |
| 5,741,183 | A | | 4/1998 | Acres et al. | 463/42 |
| 5,743,523 | A | | 4/1998 | Kelly et al. | 273/138.1 |
| 5,752,882 | A | | 5/1998 | Acres et al. | 463/42 |
| 5,758,875 | A | | 6/1998 | Giacalone, Jr. | 273/143 R |
| 5,761,647 | A | | 6/1998 | Boushy | 705/10 |
| 5,766,076 | A | | 6/1998 | Pease et al. | 463/27 |
| 5,770,533 | A | | 6/1998 | Franchi | 463/42 |
| 5,811,772 | A | | 9/1998 | Lucero | 235/380 |
| 5,816,917 | A | | 10/1998 | Kelmer et al. | 463/16 |
| 5,816,918 | A | | 10/1998 | Kelly et al. | 463/16 |
| 5,820,459 | A | | 10/1998 | Acres et al. | 463/25 |
| 5,833,540 | A | | 11/1998 | Miodunski et al. | 463/42 |
| 5,836,817 | A | | 11/1998 | Acres et al. | 463/26 |
| 5,839,956 | A | | 11/1998 | Takemoto | 463/25 |
| 5,851,148 | A | | 12/1998 | Brune et al. | 463/25 |
| 5,851,149 | A | | 12/1998 | Xidos et al. | 463/42 |
| 5,854,542 | A | | 12/1998 | Forbes | 315/291 |
| 5,902,983 | A | | 5/1999 | Crevelt et al. | 235/380 |
| 5,919,091 | A | | 7/1999 | Bell et al. | 463/25 |
| 5,967,896 | A | * | 10/1999 | Jorasch et al. | 463/25 |
| 6,012,982 | A | | 1/2000 | Piechowiak | 463/16 |
| 6,039,648 | A | | 3/2000 | Guinn et al. | 463/16 |
| 6,048,269 | A | | 4/2000 | Burns et al. | 463/25 |
| 6,077,162 | A | | 6/2000 | Weiss | 463/26 |
| 6,089,982 | A | * | 7/2000 | Holch et al. | 463/16 |
| 6,227,972 | B1 | * | 5/2001 | Walker et al. | 235/380 |
| 6,277,972 | B1 | * | 5/2001 | Walker et al. | 463/25 |
| 6,244,958 | B1 | * | 6/2001 | Acres | 463/26 |
| 6,257,981 | B1 | * | 7/2001 | Acres et al. | 463/26 |
| 6,280,326 | B1 | * | 8/2001 | Saunders | 235/379 |
| 6,280,328 | B1 | * | 8/2001 | Holch et al. | 463/42 |
| 6,302,793 | B1 | * | 10/2001 | Fertitta, III et al. | 463/25 |

FOREIGN PATENT DOCUMENTS

| | | | |
|---|---|---|---|
| AU | B-53370/86 | | 10/1989 |
| AU | B-10488/92 | | 7/1992 |
| AU | B-20986/92 | | 1/1993 |
| AU | B-71194/91 | | 5/1994 |
| AU | A-21618/95 | | 1/1996 |
| AU | A-48323/97 | | 6/1998 |
| CA | 2270031 | | 10/1999 |
| EP | 0 805 424 | A2 | 11/1997 |
| EP | 0 805 424 | A3 | 4/2000 |
| GB | 2 211 975 | A | 7/1989 |
| WO | WO 94/12256 | | 6/1994 |
| WO | WO 95/22811 | | 8/1995 |
| WO | WO 96/34345 | | 10/1996 |
| WO | WO 98/35309 | | 8/1998 |
| WO | WO 98/40140 | | 9/1998 |
| WO | WO 99/51313 | | 10/1999 |

OTHER PUBLICATIONS

Canadian Office Action dated May 24, 2007, from Canadian Application No. 2,359,127.

Australian Examiner's Report on application No. 2004242429 issued by Robert Bartram on Jan. 23, 2007.

Australian Examiner's Report on application No. 81420/01 by Robert Bartram on Aug. 3, 2004.

Australian Examiner's Report on application No. 81420/01 by Robert Bartram on Feb. 24, 2004.

Australian Examiner's Report on application No. 8142/01 by Robert Bartram on Dec. 16, 2003.

Australian Examiner's Report on application No. 81420/01 by Robert Bartram on Sep. 3, 2003.

Australian Examiner's Report on application No. 81420/01 by Robert Bartram on Nov. 19, 2002.

* cited by examiner

SYSTEM COMPONENTS

METHOD OF IMPLEMENTING CASHLESS PLAY OF GAMING DEVICES INTERCONNECTED BY A COMPUTER NETWORK

BACKGROUND OF THE INVENTION

1. Field of the Invention

This application is a continuation-in-part of U.S. patent application No. 09/134,285, filed Aug. 14, 1998. The present invention relates to a method of accounting for player's wagers, jackpots, and awards on a network of gaming machines, and more particularly to such a method that facilitates cashless play of the gaming devices.

2. Description of the Related Art

There are several prior art systems implementing cashless gaming on electronic gaming devices, such as slot machines, that are connected to a host computer via a network. Such systems typically require a player to open a cashless gaming account with the casino prior to playing. The player must appear before a casino cashier who creates a player record on the host computer, receives an initial deposit from the player, and enters the deposit as a credit in the player account. The cashier also issues a cashless-wagering card to the player, who is now ready to begin cashless gaming.

The player selects a slot machine on the casino floor and inserts his or her card into a card reader associated with the slot machine. Each of the other slot machines also include associated card readers. Most prior art systems incorporate a security feature, such as a personal identification number (PIN), that must be satisfied before the system permits the player to draw on the credit in the account. In these prior art systems, the player enters his or her PIN on a keypad associated with the slot machine and card reader after insertion of the card. When the security feature is satisfied, the amount in the player's account appears on the display associated with the slot machine. The player may then draw on the account by initiating commands at the slot machine that transfer credits from the account to the slot machine. As the player transfers money from the account to the slot machine, the credit in the account decreases. If the player should be the recipient of a jackpot or other award at the slot machine, the conventional credit meter on the slot machine increments to add the jackpot or award to the balance on the credit meter.

When the player concludes playing, the balance is transferred from the credit meter to the player's cashless-wagering account responsive to a command initiated by the player. The player then withdraws his or her card and leaves the balance in the account for placing wagers on one of the slot machines at a future time, which may be a few hours, a few days, or longer.

SUMMARY OF THE INVENTION

Gaming devices are interconnected by a network to a host computer. A player account accessible by a host computer is created. Access to the account is provided responsive to a first command initiated by a player at one of the gaming devices. Credit is then transferred from the account to the gaming device, which the player then plays. After play, the player cashes out from the gaming device using a second command at the gaming device.

DETAILED DESCRIPTION OF THE PREFERRED EMBODIMENT

Figure 1:
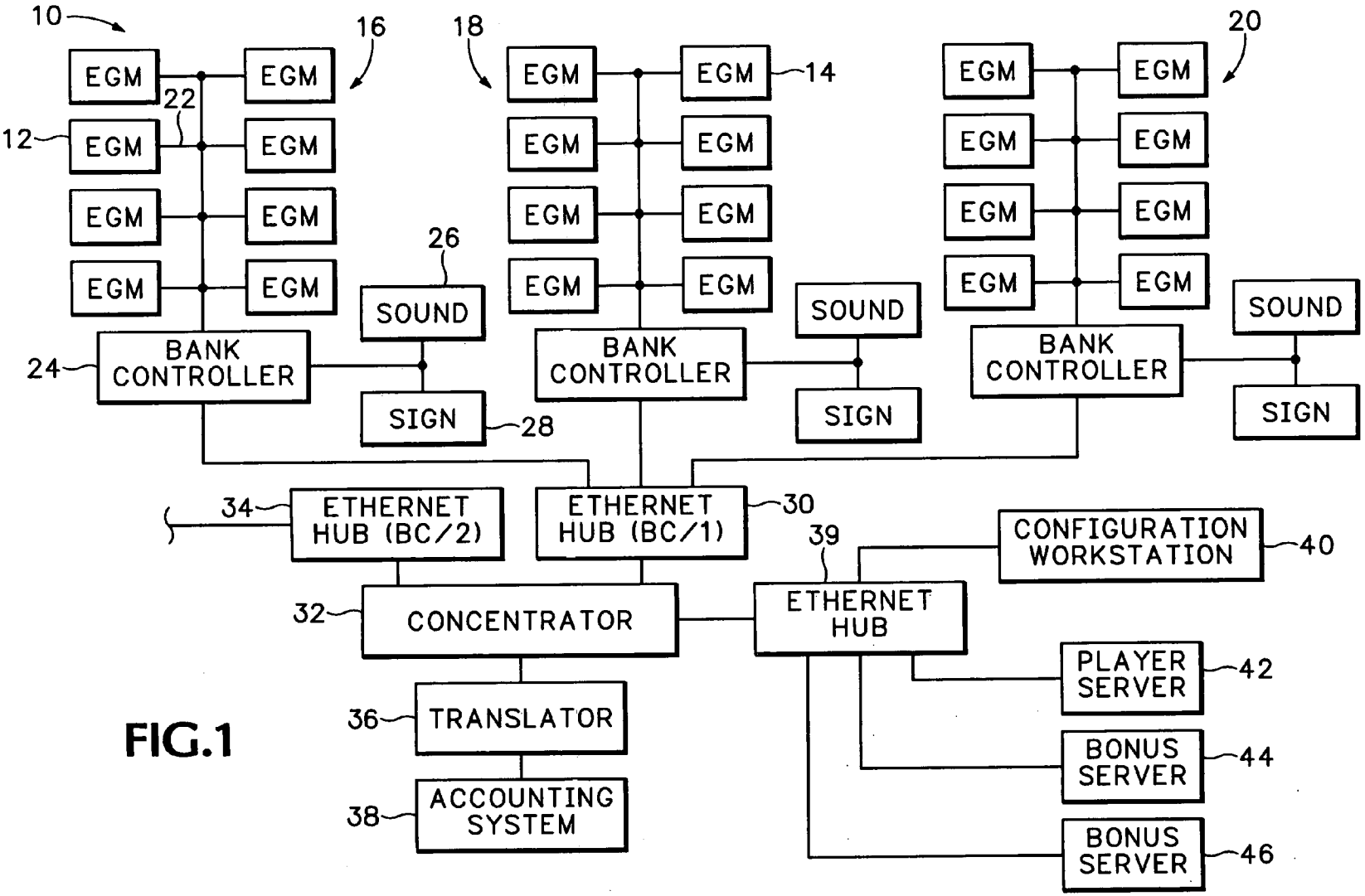
FIG. 1 is a schematic diagram of a plurality of electronic gaming machines interconnected by a computer network to a host computer in accordance with the present invention.

Turning now to FIG. 1, indicated generally at 10 is a schematic diagram illustrating electronic gaming machines (EGMs), like EGMs 12, 14, interconnected by a computer network. In the present embodiment, the EGM comprises a slot machine. Included in the network are three banks, indicated generally at 16, 18, 20, of EGMs. Each EGM is connected via a network connection, like connection 22, to a bank controller 24. In the present embodiment of the invention, each bank controller comprises a processor that facilitates data communication between the EGMs in its associated bank and the other components on the network. The bank controller also includes a CD ROM drive for transmitting digitized sound effects, such as music and the like, to a speaker 26 responsive to commands issued over the network to bank controller 24. The bank controller is also connected to an electronic sign 28 that displays information, such as jackpot amounts and the like, visible to players of machines on bank 16. Such displays are generated and changed responsive to commands issued over the network to bank controller 24. Each of the other banks 18, 20 of EGMs include associated bank controllers, speakers, and signs as shown, which operate in substantially the same manner.

Ethernet hub 30 connects each of the bank controllers associated with banks 16, 18, 20 of EGMs to a concentrator 32. Another Ethernet hub 34 connects similar bank controllers (not shown), each associated with an additional bank of EGMs (also not shown), to concentrator 32. The concentrator functions as a data control switch to route data from each of the banks to a translator 36. The translator comprises a compatibility buffer between the concentrator and a proprietary accounting system 38. It functions to place all the data gathered from each of the bank controllers into a format compatible with accounting system 38. The present embodiment of the invention, translator 38 comprises an Intel PENTIUM 200 MHz Processor operating Microsoft WINDOWS NT 4.0.

Another Ethernet hub 39 is connected to a configuration workstation 40, a player server 42, and to bonus servers 44, 46. Hub 39 facilitates data flow to or from workstation 40 and servers 42, 44, 46.

The configuration workstation 40 comprises a user interface. It comprises a personal computer including a keyboard, Intel PENTIUM Processor and Ethernet card.

The player server 42 comprises a microcomputer that is used to control messages that appear on displays associated with each EGM. Player server 42 includes an Intel PENTIUM Processor and an Ethernet card.

Bonus servers 44, 46 each comprise a microcomputer used to control bonus applications on the network. Each bonus application comprises a set of rules for awarding jackpots in excess of those established by the pay tables on each EGM. For example, some bonus awards may be made randomly, while others may be made to link to groups of EGMs operating in a progressive jackpot mode. Examples of bonuses that can be implemented on the network are disclosed in copending application Ser. No. 08/843,411, filed Apr. 15, 1997 and assigned to the Assignee of the present application (the '411 application), which is incorporated herein by reference for all purposes. This co-pending application also describes in more detail features of the network, like that shown in FIG. 1, that may be used to implement the present invention. Also incorporated herein by reference for all purposes is U.S. Pat. No. 5,655,961, assigned to the Assignee of the present application (the '961 patent), which also discloses bonuses that can be implemented by bonus servers 44, 46 and a network that could be used to implement the present invention.

Figure 2:
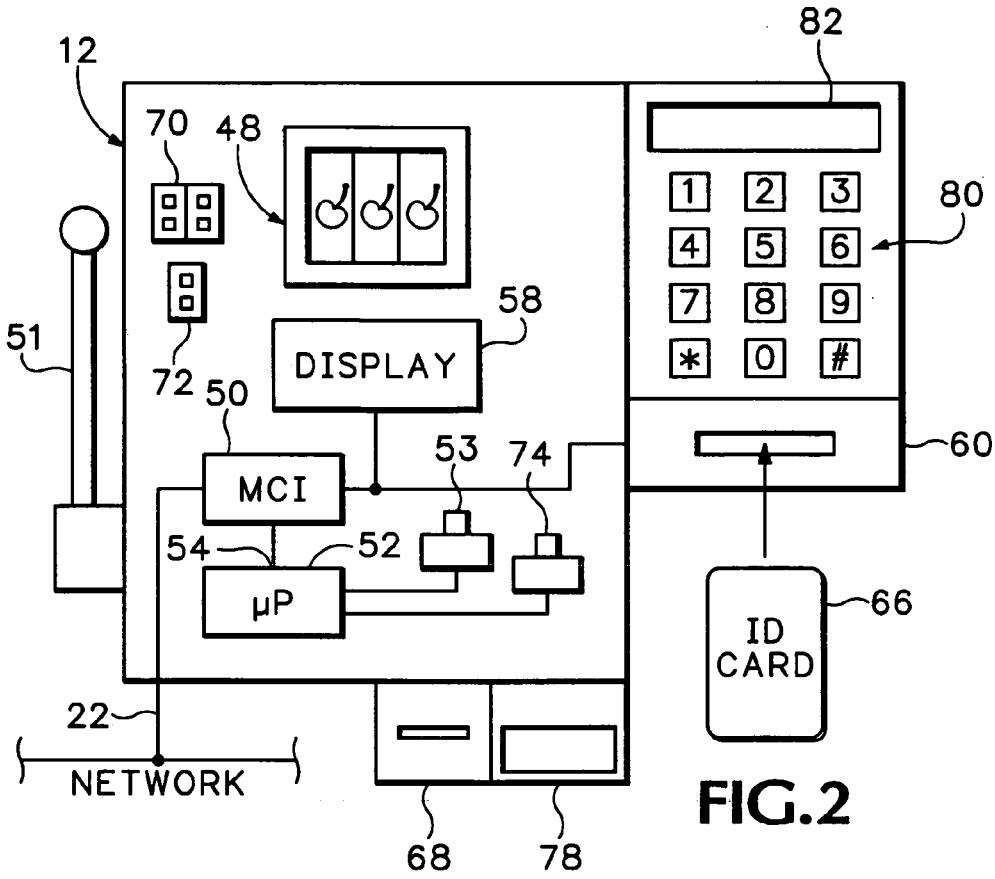
FIG. 2 is a schematic diagram of a slot machine and associated hardware implemented in accordance with the present invention.

FIG. 2 is a highly schematic representation of an electronic slot machine, which is typical of each of the machines in the network, and which incorporates network communications hardware as described hereinafter. This hardware is described in the '961 patent, and is referred to therein as a data communications node. Preferably the network communications hardware is like that disclosed in the '411 application, namely a machine communication interface (MCI) 50. MCI 50 facilitates communication between the network, via connection 22, and microprocessor 52, which controls the operation of EGM 12. This communication occurs via a serial port 54 on the microprocessor to which MCI 50 is connected.

Included in EGM 12 are three reels, indicated generally at 48. Each reel includes a plurality of different symbols thereon. The reels spin in response to a pull on handle 51 or actuation of a spin button 53 after a wager is made.

MCI 50 may include a random access memory (RAM), which can be used as later described herein. The MCI also facilitates communication between the network and a vacuum florescent display (VFD) 58, and a card reader 60.

Before describing play according to the invention, description will first be made of a, typical play on a slot machine, like EGM 12. A player plays EGM 12 by placing a wager and then pulling handle 51 or depressing spin button 53. The wager may be placed by inserting a bill into a bill acceptor 68. A typical slot machine, like EGM 12, includes a coin acceptor (not shown) that may also be used by the player to make a wager. A credit meter 70 is a numeric display that indicates the total number of credits available for the player to wager. The credits are in the base denomination of the machine. For example, in a nickel slot machine, when a five-dollar bill is inserted into bill acceptor 68, a credit of 100 appears on credit meter 70. To place a wager, the player depresses a coin-in button (not shown), which transfers a credit from the credit meter 70 to a coin-in meter 72. Each time the button is depressed a single credit transfers to the coin-in meter up to a maximum bet that can be placed on a single play of the machine. Alternatively, a maximum bet button (also not shown) is provided to immediately transfer the maximum number of credits that can be wagered on a single play from the credit meter 70 to the coin-in meter 72.

When coin-in meter 72 reflects the number of credits that the player intends to wager, the player depresses spin button 53 thereby initiating a game.

The player may choose to have any jackpot won applied to credit meter 70. When the player wishes to cash out, the player depresses a cash-out button 74, which causes the credits on meter 70 to be paid in coins to the player at a hopper 78, which is part of machine 12. The machine consequently pays to the player, via hopper 78, the number of coins—in the base denomination of the machine—that appear on credit meter 70.

Typical slot machines, like machine 12, are limited in the total amount of coins that can be paid to the player from the hopper. Thus, when jackpots are in excess of the hopper-pay limit, the machine locks up and the jackpot is hand paid by casino personnel to the player. After the jackpot is so paid, the casino personnel resets the machine to permit play to resume.

Card reader 60 reads a player-tracking card 66 that is issued by the casino to individual players who choose to have such a card. Card reader 60 and player-tracking card 66 are known in the art, as are player-tracking systems, examples being disclosed in the '961 patent and '411 application. Briefly summarizing such a system, a player registers with the casino prior to commencing gaming. The casino issues a unique player-tracking card to the player and opens a corresponding player account that is stored on accounting system 38 (in FIG. 1). The account includes the player's name and mailing address and perhaps other information of interest to the casino in connection with marketing efforts. Prior to playing one of the EGMs in FIG. 1, the player inserts card 66 into reader 60 thus permitting accounting system 38 to track player activity, such as amounts wagered and won and rate of play.

When the casino opens a player account, it may implement a coinless transfer feature in accordance with the present invention. When the account is so flagged by the casino, play may proceed as follows.

The player selects one of the network slot machines—in this case machine 12—and inserts card 66 into reader 60. The player then inserts one or more bills into bill acceptor 68, which purchases a corresponding number of credits in the base denomination of the machine that are applied to and appear on credit meter 70. The player may also, of course, apply credits to the credit meter by depositing coin in the coin acceptor (not shown) that is part of machine 12. When the player inserts card 66 into reader 60, the player record that the casino created on accounting system 38 is fetched from the accounting system and loaded into memory in MCI 50. Insertion of card 66 into card reader 60 is referred to herein as a first command or a log-in command.

After the credits are displayed on meter 70, the player plays slot machine 12 in a conventional manner as described above. That is, the coin-in button (not shown) is depressed by the player to transfer the desired number of credits from credit meter 70 to coin-in meter 72. After so doing, the player presses spin button 53 to spin reels 48. Upon completion of the game, i.e., after the reels stop spinning, any jackpot payable according to a pay table internal to machine 12 is also applied to credit meter 70. Similarly, any bonuses, i.e., any payments to the player that result from awards not generated by the pay table in machine 12, as described in the '961 patent, are also applied to credit meter 70.

When the player concludes play on machine 12, he or she has two options for redeeming any balance remaining on credit meter 70. First, if cash-out button 74 is depressed while card 66 is received in card reader 60, the credits on meter 70 are transferred to the player account record contained in the RAM in MCI 50. Credit meter 60 then reads 0 credits, and the number of credits displayed on meter 70 when cash-out button 74 is depressed is associated with the player record in the RAM of MCI 50. As soon as this transfer occurs, display 58 indicates the amount transferred to the player. After the transfer to the RAM in MCI 50, the player record and associated credits is transferred via connection 22 over the network to the host computer. The term host computer as used herein may refer to a processor, a controller, or memory, which may be located anywhere, including multiple locations, on the network. In the present case, the host computer includes a dedicated storage area on player server 42. The information stored includes the amount, dollar amount, time that storage occurred and the machine number from which the credit was stored, all of which is associated with the identifying player record. Other data associated with the player record, such as the amounts wagered and won, is stored on accounting system 38 in accordance with prior art player tracking systems.

Typically the player leaves the card in the card reader from beginning to end of play. This allows the player to be credited for points that can be redeemed for awards. It should be noted, however, that to effect the coinless transfer feature, the card need only be inserted when cash-out button 74 is depressed. In other words, the card need not necessarily be in the card reader during play—the record can be fetched and the credits stored in the player account after all play is complete.

Alternatively, when the player concludes gaming on machine 12, he or she may choose to receive payment via hopper 78 at the machine. If so, the player withdraws card 66 from reader 60 before pressing cash-out button 74. Withdrawal of card 66 from card reader 60 is referred to herein as a second command or a log-out command. Because credits remain on credit meter 70, the player record in RAM of MCI 50 indicates 0 credits, which is stored to the host computer as described above with the player record. The player now depresses cash-out button 74 thus causing the machine to pay credits from meter 70 to hopper 78 in the usual fashion. Depressing cash-out button 74 is referred to herein as a request to redeem the balance stored on the credit meter.

Each slot machine includes conventional controls for setting a maximum amount payable from the hopper of the machine based upon the hoppers capacity and the casino's wishes. In addition, a maximum amount payable at hopper 78 may also be set by the casino at configuration workstation 40 to prevent a player from cashing out credits over a predetermined maximum value. If either value—the value set at the machine or the value set at the workstation—is exceeded, machine 12 locks up in the same fashion as if it had won a jackpot that exceeded the maximum amount payable from the machine hopper.

When a player elects to cash out by storing his or her balance with their player record on the host computer as described above, the player may use the card to transfer the credit to another slot machine on the network. To do so, the player moves to another machine, perhaps after taking a short break, and inserts his or her card 66 into the card reader, like card reader 60, associated with the new slot machine. The MCI, like MCI 50, at the new machine detects insertion of the card. The appropriate player record is called from the host computer, including the record stored on bonus server 44 having the amount of credits stored in the player's account. That record and the associated credits are stored initially in the RAM of MCI 50. The number of credits associated with the record is then transferred to the credit meter of the new machine without any further action on the part of the player. Play then continues as described above, including cashing out by either restoring the balance on the credit meter with his or her account on the host computer or withdrawing the card and cashing out to obtain payment via the machine hopper.

In another embodiment of the present invention, the coinless transfer feature may be implemented without requiring a player to deal with casino personnel. In this embodiment, the player account is anonymous, and is created by the player. In this embodiment, the casino provides an automated card dispenser, each card being coded with an anonymous player account that exists on the host computer. The player simply takes one of the cards from the dispenser and uses it to play as described above. The player has the same options to cash out, namely depressing cash-out button 74 with the card withdrawn to receive coin at the machine and depressing the cash-out button with the card inserted to apply the machine credits to his or her anonymous account in the same manner as described above for an account associated with an identified player. In the latter instance, when the player wishes to resume play, they merely insert the card into the card reader associated with the selected slot machine and credits are applied to the credit meter of the slot machine as described above. The player can also cash out by presenting the card to the cashier, also as described above. The anonymous coinless transfer system is advantageous in that casino personnel are not required to activate the coinless transfer feature.

In another aspect, the present invention limits the time between storing credits to a player's account, whether anonymous or not, and accessing the account to resume play with credits in the account. In this aspect, the host computer initiates a timed count when the player withdraws his or her card from the card reader. The casino may select—at configuration workstation 40—a maximum time, for example, 2 hours, that the player may access the account using a card reader. If this time is exceeded, the credits will not transfer from the account to the credit meter of the slot machine when the card is inserted. The player must therefore present the card to a casino cashier who can access the account using a card reader and reimburse the player with the total amount credited to his or her account. This feature reduces potential casino liability by not permitting card access to deposited credits for extended periods.

Consideration will now be given to yet another embodiment of the invention. Turning again FIG. 2, this embodiment includes a keypad 80 and a vacuum fluorescent display 82, which in the present embodiment are associated with card reader 60. The keypad and display communicate with MCI 50 as described in the '961 patent.

Figure 3:
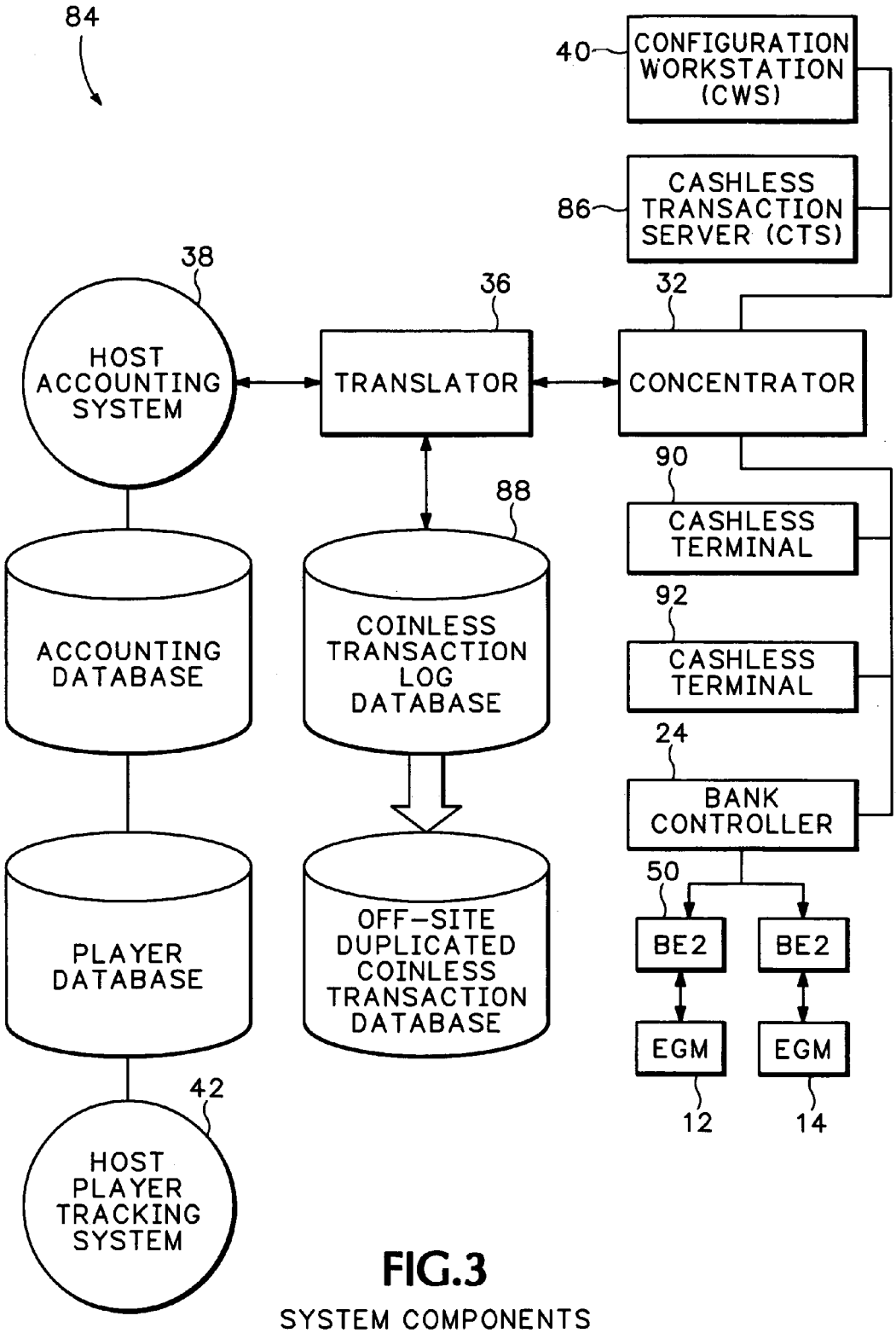
FIG. 3 is a schematic diagram of another embodiment of the invention.

Turning now to FIG. 3, indicated generally at 84 is a schematic diagram of a system including EGMs interconnected by a computer network, which implements this embodiment of the invention. Numbers corresponding to structure identified in the previously-described embodiments identify corresponding structure in system 84. It should be appreciated that variations in the manner in which the components are interconnected by the network can be readily made by a person having ordinary skill in the art to which the invention relates.

Also included in system 84 is a cashless transaction server (CTS) 86, which comprises a computer similar to those implementing player server 42 and bonus servers 44, 46 in the embodiment of FIG. 1.

Also included in system 84 is a cashless transaction log database 88. As will be soon described, CTS 86 maintains a record of each cashless play account, including the player associated with that account and the current balance in the account. In the present embodiment of the invention, database 88 is a commercially available database that stores records delivered over the network relating to each cashless play transaction at each of the EGMs on the network in a matter that will be more fully explained hereafter. An off-site database 94 duplicates the information in database 88 as it is entered.

Finally, cashless terminals 90, 92, each preferably comprise a card reader, like card reader 60 in FIG. 2, a computer connected to the network as shown in system 84, printer connected to the computer, and a keypad, similar to keypad 80. In addition, a communications board, similar to MCI 50, is located at each terminal to place the terminal in communication with the network. Typically terminals 90, 92 are located remote from one another in a casino and are operated by a casino employee to establish accounts and to deposit and withdraw money from the accounts, as will be more fully explained in the following description of the operation of this embodiment.

When the casino opens a player account it may implement a cashless play feature in accordance with the present invention. The cashless play feature and the player account may be implemented at one of terminals 90, 92. When the cashless play feature is implemented, it may be implemented in accordance with the first embodiment, i.e., to permit transfers from one machine to another. Alternatively, the cashless feature can be implemented to permit a player to deposit funds at an EGM in accordance with the first embodiment but require the player to withdraw funds only at one of terminals 90, 92 by presenting his or her card to an agent of the casino, typically an employee, operating the terminal. The casino employee, in turn, accesses the network to determine the account balance and pays it to the customer in a manner that will be more fully described hereinafter. Finally, the cashless account may be implemented in a manner that requires the casino employee to receive initial funds and credit them to the account at one of terminals 90, 92. But the account may be cashed out at one of the EGMs on the floor in a manner that will be described more fully hereinafter.

The account is opened by receiving information about the player, defining the type of account, and entering this information into CTS 86 via one of terminals 90, 92. In addition, the player is asked to select a personal identification number (PIN), known only to the player. This number is typically entered by the player at a keypad located at the terminal. The PIN is associated with the player's account on CTS 86 and is used for security purposes as will be soon described.

In any event, after the account is initially funded, whether by the player at the EGM as described in connection with the first embodiment or via crediting the account with funds presented to a casino employee at one of terminals 90, 92, the player approaches one of the gaming machines, e.g., EGM 12, to begin play.

Figure 4:
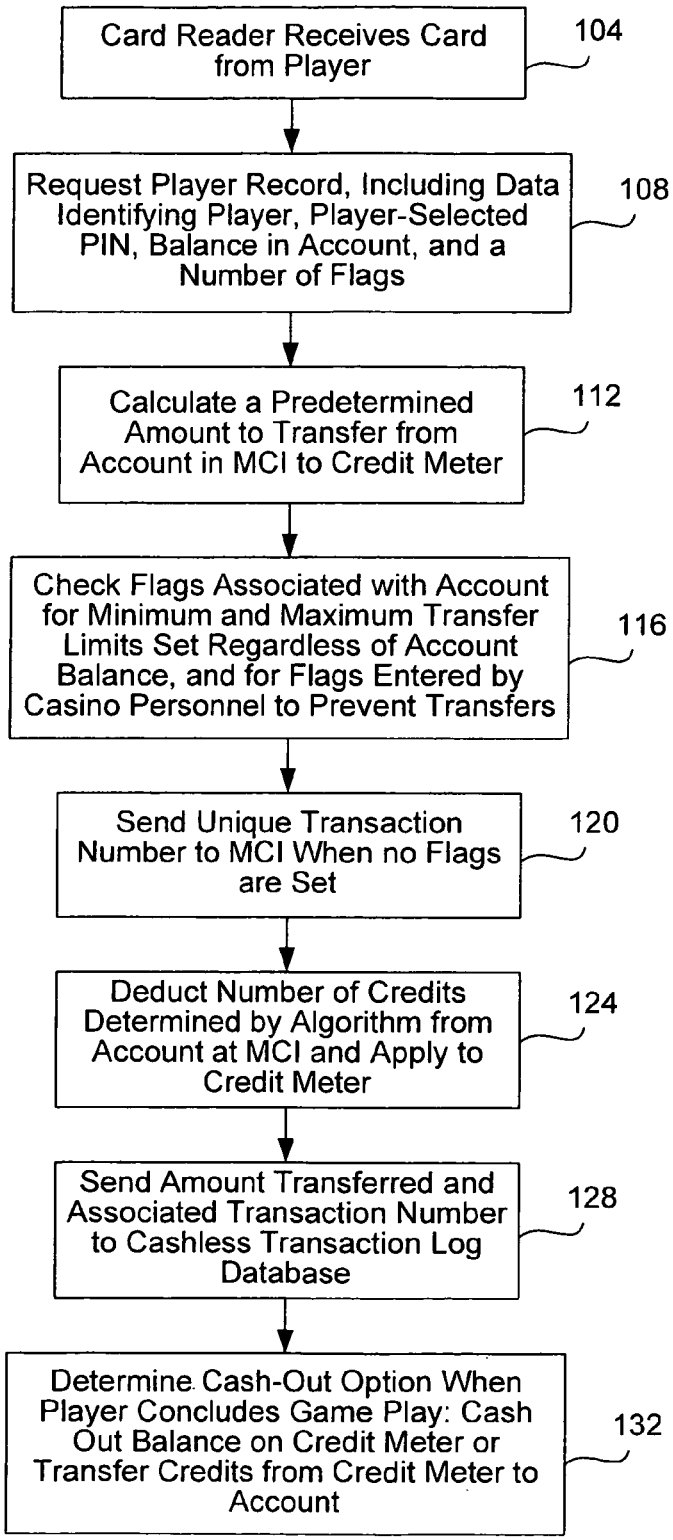
FIG. 4 is a flow diagram of another embodiment of the invention.

Turning now to FIG. 4, indicated generally at 100 is a flow diagram of a method, which implements this embodiment of the invention.

The player first inserts card 66 into card reader 60, in step 104. This initiates a first network communication, in step 108, which is a query from MCI 50 (in response to the card insertion) to CTS 86 requesting the player record. The record includes data identifying the player, the player-selected PIN, the balance in the account, and a number of flags, which can set features that will be described shortly.

CTS 86 responds to this query first by using a Secure Hash Algorithm (SHA) to hash the player's PIN at CTS 86. The CTS then sends the player record, including the hashed PIN, to MCI 50, which stores it in the MCI RAM. Once CTS 86 sends the record, it locks the record stored at the CTS thereby creating a session lock for the duration of the session, which is the period between when card 66 is inserted into and withdrawn from card reader 60. When the session lock is activated, the record can be retrieved from CTS 86, but the record includes an indication that it is locked thereby preventing any account transaction using the locked record.

After the player record is stored at MCI 50, the player uses keypad 80 to select cashless play. An algorithm that is part of the software stored in read only memory (ROM) (not shown) in MCI 50 then calculates an amount to transfer from the account in MCI 50 to credit meter 70 on EGM 12, in step 112. The amount transferred in step 112 is a predetermined amount calculated by the algorithm; it is not selected by the player using keypad 80. In step 116, the algorithm checks flags associated with the account for minimum and maximum transfer limits that are imposed at one of terminals 90, 92 when the account is opened. These minimums and maximums are set regardless of the account balance. The algorithm, of course, also examines the account balance and does not permit a transfer in excess of the account balance. The ability to set maximum limits regardless of account balance is a tool that can be used to address problem gamblers, among other things.

In an alternative embodiment, the player may select an amount via keypad 80, either by keying in the amount using numeric keys on the keypad, or by selecting from one of a plurality of keys each of which is associated with a predetermined transfer amount, e.g., $50, $100, $150, etc.

After insertion of card 66 into reader 60, resulting in storing the player's record in MCI 50 as described above, the player indicates whether the transfer is to be from the credit meter 70 on EGM 12 to the account in MCI 50 or vice versa. Of course, at the beginning of the session there is typically no money on credit meter 70 of EGM 12. The player consequently selects a transfer from his or her account to credit meter 70. After selecting whether the transfer is to or from the EGM as described above, the player is then prompted by display 82 to enter his or her PIN.

After entry of the PIN, MCI 50 uses the same SHA, which is also stored in ROM on MCI 50, that hash the PIN at CTS 86 to hash the PIN entered by the player at EGM 12. MCI 50 then compares the hashed PIN transmitted with the player record from CTS 86 with the hashed PIN entered at EGM 12 to confirm that they match before the transaction can continue.

If the hashed PINs match, MCI 50 makes a validation request over the network to CTS 86 before making the transfer—either from credit meter 70 to the account or visa versa—selected by the player. Assuming there is a sufficient balance, i.e., the minimum is met and no flags are set that otherwise prevent the transfer, in step 120, CTS 86 responds by sending a unique transaction number to MCI 50. It should be noted in step 116 that one of the flags can be entered by casino personnel from one of terminals 90, 92 to prevent any transfers. A flag might be so set when, e.g., a player reports a lost card.

Once the unique transmission number is received by MCI 50, MCI 50 retrieves the balance on credit meter 70 and transmits it to CTS 86. This transmission and each network transmission that follows are associated with the unique transaction number. After MCI 50 receives a response from CTS 86 indicating successful transfer of the initial state of meter 70, in step 124, the number of credits determined by the algorithm are deducted from the account at MCI 50 and applied to credit meter 70. Next, the balance on credit meter 70 is again transmitted to CTS 86 and a response returned to MCI 50 to confirm that communication.

In step 128, MCI 50 then associates the amount transferred from the account to credit meter 70 with the transaction number and then communicates it to cashless transaction log database 88. CTS 86, which has both the initial and final states of credit meter 70, calculates the amount of the transaction by subtracting the meter states, associates that value with the transaction number, and sends it to cashless transaction log database 88. The computer operating database 88 receives the meter difference transmitted by CTS 86 and the amount transferred from the account transmitted by MCI 50 and stores both values associated with the transaction number.

Transfers between CTS 86 and one of terminals 90, 92 are effected in substantially the same manner, i.e., the communications board, like MCI 50, at the terminal receives the player record from CTS 86, the player enters his or her PIN, and so forth.

If a transaction is not posted by CTS 86, one of the EGMs, or one of terminals 90, 92, cashless account variances are easily detected using the data stored on database 88. In addition, in the event of a system failure, such as a malfunction or destruction of CTS 86, player account balances can be reconstructed using the information stored in database 88. Even if a catastrophic event prevents recovery of information from any of system 84 located at the casino, the off-site duplicated database 94, can be used to reconstruct player account balances.

Any transfer to or from the player's cashless accounts generates the above communications. When the player concludes playing, in step 132, several options may be available depending on how the cashless play feature was implemented for that particular player. First, assuming the player has the capability of cashing out at EGM 12, he or she can simply use cash-out button 74 to cash out the balance on credit meter 70 at EGM 12 in the usual fashion. If, however, that feature is not implemented, the player can initiate a transfer from the credit meter to the account as described above. In an alternative embodiment, any credits remaining on credit meter 70 are automatically returned to the account at the MCI 50 when the card is withdrawn. The system may also be configured to lock up in response to a large jackpot or a machine malfunction, either of which may require withdrawal of the player's card and insertion of a card issued to a casino employee to effect the transfer. Once the transfer is effective, the account record is returned to CTS 86 from MCI 50, and the session lock is released. Regardless of how the cashless account is set up, the player may always approach of one of terminals 90, 92, present his or her card, and receive and withdraw money from the account.

What is claimed is:

1. A method for transferring credits at a gaming device in communication with a host computer over a network, the host computer having an account associated with a player, the account having a balance, the method comprising:

receiving player identification information at the gaming device, the player identification information identifying the player;

retrieving a determined amount of the account balance from the host computer over the network, the amount of the account balance determined in accordance with one or more flags associated with the account;

storing the retrieved balance on a credit meter associated with the gaming device;

storing any award resulting from play of the gaming device on the credit meter, including updating the balance on the credit meter; and providing information indicating the balance on the credit meter to the host computer over the network.

2. The method of claim 1, further comprising:

receiving, at the gaming machine, a request to redeem the balance on the credit meter.

3. The method of claim 1, wherein the player identification information is received at an interface of the gaming device.

4. The method of claim 1, wherein retrieving the determined amount of the account balance from the host computer of the network includes:

sending a query to the host computer, the query requesting player data associated with the identified player.

5. The method of claim 1, wherein the flags indicate one or more selected from the group consisting of: a minimum transfer limit, a maximum transfer limit, and a transfer prevention.

6. The method of claim 5, wherein the minimum and maximum transfer limits are set regardless of the account balance.

7. The method of claim 5, wherein the transfer prevention is associated with a report of a lost player card.

8. The method of claim 5, wherein the transfer prevention is associated with an instruction from a casino operator.

9. The method of claim 1, wherein retrieving the determined amount of the account balance from the host computer of the network includes:

deducting the determined amount from the account balance.

10. The method of claim 1, wherein the determined amount of the account balance is retrieved from the host computer responsive to receiving the player identification information.

11. The method of claim 1, wherein the determined amount of the account balance is retrieved from the host computer responsive to a player input.

12. The method of claim 1, wherein the information indicating the balance on the credit meter is provided to the host computer responsive to a player input.

13. The method of claim 1, further comprising:

sending transaction information identifying the transfer to a transaction log database having initial and final states of the credit meter.

14. The method of claim 1, further comprising:

determining a cash-out option for the player, including outputting a credit balance on the credit meter from an output device at the one gaming device.

15. The method of claim 14, wherein the cash-out option is determined responsive to a player selection.

16. The method of claim 1, wherein the player is anonymous.

17. A gaming device in communication with a host computer over a network for transferring credits between the gaming device and the host computer, the host computer having an account associated with a player, the account having a balance, the gaming device comprising:

a player interface coupled to receive player identification information, the player identification information identifying the player; and a processor configured to:

retrieve a determined amount of the account balance from the host computer over the network, the amount of the account balance determined in accordance with one or more flags associated with the account, store the retrieved balance on a credit meter, store any award resulting from play of the gaming device on the credit meter, including updating the balance on the credit meter; and provide information indicating the balance on the credit meter to the host computer over the network.

18. The gaming device of claim 17, wherein the player interface includes a card reader.

19. The gaming device of claim 17, the processor further configured to:

receive a request to redeem the balance on the credit meter.

20. The gaming device of claim 17, wherein retrieving the determined amount of the account balance from the host computer of the network includes:

sending a query to the host computer, the query requesting player data associated with the identified player.

21. The gaming device of claim 17, wherein the flags indicate one or more selected from the group consisting of: a minimum transfer limit, a maximum transfer limit, and a transfer prevention.

22. The gaming device of claim 17, the processor configured to retrieve the determined amount of the account balance from the host computer responsive to receiving the player identification information.

23. The gaming device of claim 17, the processor configured to retrieve the determined amount of the account balance from the host computer responsive to a player input.

24. The gaming device of claim 17, the processor configured to provide the information indicating the balance on the credit meter to the host computer responsive to a player input.

25. The gaming device of claim 17, the processor further configured to:

send transaction information identifying the transfer to a transaction log database having initial and final states of the credit meter.

26. The gaming device of claim 17, the processor further configured to:

determine a cash-out option for the player, including outputting a credit balance on the credit meter from an output device at the one gaming device.

27. A host computer in communication with a gaming device over a network for transferring credits between the host computer and the gaming device, the host computer having an account associated with a player, the account having a balance, the host computer comprising:

an interface coupled to receive player identification information identifying the player;

a processor configured to:

access the player account associated with the player;

provide an amount of the account balance for the gaming device over the network, the amount of the account balance determined in accordance with one or more flags associated with the account;

the interface further coupled to receive information indicating un updated balance from the gaming device over the network.

28. The host computer of claim 27, wherein the flags indicate one or more selected from the group consisting of: a minimum transfer limit, a maximum transfer limit, and a transfer prevention.

29. The host computer of claim 28, wherein the minimum and maximum transfer limits are set regardless of the account balance.

30. The host computer of claim 28, wherein the transfer prevention is associated with a report of a lost player card.

31. The host computer of claim 28, wherein the transfer prevention is associated with an instruction from a casino operator.

32. The host computer of claim 28, the processor further configured to:

send transaction information identifying the transfer to a transaction log database having initial and final states of the credit meter.

* * * * *